US009016436B2

(12) United States Patent
Paluncic et al.

(10) Patent No.: US 9,016,436 B2
(45) Date of Patent: Apr. 28, 2015

(54) DEVICE FOR WETTING OR LUBRICATING A RAIL HEAD

(75) Inventors: Zdravko Paluncic, Ludwigshafen (DE); Markus Mandera, Leimen (DE)

(73) Assignee: Lincoln GmbH, Walldorf (DE)

( * ) Notice: Subject to any disclaimer, the term of this patent is extended or adjusted under 35 U.S.C. 154(b) by 168 days.

(21) Appl. No.: 13/556,361

(22) Filed: Jul. 24, 2012

(65) Prior Publication Data

US 2013/0025972 A1 Jan. 31, 2013

(30) Foreign Application Priority Data

Jul. 25, 2011 (DE) ..... 20 2011 103 633 U

(51) Int. Cl.
*B61K 3/00* (2006.01)
*E01B 19/00* (2006.01)

(52) U.S. Cl.
CPC ..... *B61K 3/00* (2013.01); *E01B 19/003* (2013.01)

(58) Field of Classification Search
USPC ..... 184/3.1, 3.2
See application file for complete search history.

(56) References Cited

U.S. PATENT DOCUMENTS

| | | | | |
|---|---|---|---|---|
| 1,899,767 | A | 8/1933 | Merk | |
| 1,923,449 | A | 8/1933 | Merk | |
| 4,520,901 | A * | 6/1985 | Borup et al. | 184/3.1 |
| 6,619,429 | B1 * | 9/2003 | Brand | 184/3.1 |
| 6,631,786 | B1 * | 10/2003 | Gunacker | 184/3.1 |
| 6,742,624 | B2 | 6/2004 | DiCarlo | |
| 8,584,804 | B2 * | 11/2013 | Holland | 184/3.1 |
| 2004/0011593 | A1 * | 1/2004 | Appleby et al. | 184/3.1 |
| 2005/0145438 | A1 * | 7/2005 | Kumar et al. | 184/3.1 |
| 2009/0000869 | A1 | 1/2009 | Holland | |

FOREIGN PATENT DOCUMENTS

| | | | |
|---|---|---|---|
| DE | 28 42 258 | C2 | 4/1979 |
| DE | 10 2004 060 804 | A1 | 7/2006 |
| EP | 1 999 000 | B1 | 12/2008 |
| GB | 2446504 | A | 8/2008 |
| WO | 2007110887 | A1 | 10/2007 |

OTHER PUBLICATIONS

Extended European Search Report, European Application No. 12176571.3, Jun. 3, 2013, 7 pgs.
T. Knauer, "Spurkranz- and Schienenkopf- schmieranlagen zur Senkung der LCC", El-Eisenbahningenieur (51) Sep. 2000, 8 pages.
German Search Report dated Nov. 14, 2011 from German Patent Application No. DE 20 2011 103 633.6, 8 pages.

* cited by examiner

*Primary Examiner* — William E Dondero
*Assistant Examiner* — Robert T Reese
(74) *Attorney, Agent, or Firm* — Senniger Powers LLP

(57) ABSTRACT

The present invention relates to a device for wetting or lubricating a rail head (7). The device has at least one outlet (30) for a wetting agent and/or lubricant. To ensure that the noise generated by a track-bound vehicle is reduced safely and regardless of the weather, a rail head-side end portion (33) of the at least one outlet (30) is movably mounted between a position at a remote distance from the rail head (7) and a position in closer proximity to the rail head.

9 Claims, 4 Drawing Sheets

DEVICE FOR WETTING OR LUBRICATING A RAIL HEAD

FIELD OF INVENTION

The present invention relates to a device for wetting or lubricating a rail head with at least one outlet for a wetting agent and/or lubricant.

BACKGROUND

In past years, the volume of traffic in metropolitan areas and in areas of industrial agglomeration has increased considerably. To relieve the traffic volume on roads, many cities and communities try to divert the flow of traffic to rail-mounted public means of transportation, such as trams, light rail systems, subway systems and S trains.

In recent years, concerns of environmental protection, such as noise pollution, have increasingly taken center stage in discussions about an expansion of the rail-mounted traffic network. In this context, it is generally known that, especially when negotiating curves with rail-bound vehicles, vibrations are excited due to the lateral slide of the wheel on the rail and the associated static friction. These vibrations lead to increased wheel and rail wear as well as to structure-borne and air-borne noise emissions. To reduce the static friction, and thus to minimize the noise generated, lubrication devices are used, by means of which it is possible to lubricate especially the rail head of a rail.

The publication EI—Eisenbahningenieur (51) September 2000, pp. 54 ff., describes a rail head lubrication device which, during curve negotiations, sprays separating agents for rail head lubrication onto the surface of the rails. This device is part of a combined wheel flange and rail head lubrication device of a rail-bound vehicle. The two components of this device share a compressed air supply and control unit. The disadvantage of this solution is that because of the remote distance from the lubrication site, the lubricant, during application of the lubricant by means of a nozzle, is mixed with compressed air. As a result, the system is sensitive to changes in the weather and does not always function reliably. In addition, the lubricant is distributed over a large area, which further contributes to damage to the environment.

The publication DE 10 2004 060 804 A1 discloses a rail lubrication and wetting device for rail-bound vehicles on a track on which the vehicle in question is rail-guided. In the prior art system, the groove of the grooved track serves as a reservoir for the lubricant; this groove can be filled with a flowable lubricant up to a predetermined level of the lubricant via at least one supply line. The lubricating groove in the rail used in this proposed solution is not always desirable; furthermore, due to the fact that it is used in an outdoor environment, it is also vulnerable to weather and pollution.

Thus, the problem to be solved by the present invention is to make available a device for wetting or lubricating a rail head, which device safely reduces the noise of a rail-bound vehicle regardless of the weather.

SUMMARY

Specifically, in the device according to the present invention for wetting and/or lubricating a rail head, the rail head-side end portion of the at least one outlet is movably mounted between a first position disposed at a remote distance from the rail head and a second position disposed in closer proximity to the rail head. In the first position in which the rail head-side end portion of the at least one outlet is disposed in a position at a remote distance from the rail head, no lubricating and/or wetting agent is dispensed. In this position, the rail head-side end portion of the outlet is in an essentially inactive standby position or rest position.

When the rail is to be lubricated and/or wetted, for example, at certain intervals that are predetermined by a control unit, the device according to the present invention is triggered and the rail head-side end portion is moved into the second position that is disposed in closer proximity to the rail head. In this activated position, the wetting and/or lubricating agent (hereinafter referred to, in short, as lubricant) is applied to the rail head, in particular to a top surface of the rail head. Preferably, at least part, most preferably the front part, of the rail head-side end portion of the outlet is in the second position above the rail head, in particular above the top surface of the rail head. Alternatively, the front tip of the end portion on the side of the rail head can be disposed directly on, i.e., at most at a distance of a few millimeters from, the lateral surface and above the top surface of the rail head. In the first position, the front tip of the end portion on the side of the rail head in the horizontal direction is located, for example, at least approximately 100 mm, preferably at least approximately 135 mm, from the inside flank or lateral surface of the rail that lies opposite the side of the rail from which the outlet approaches the rail. In the second position, the front tip of the end portion on the rail head side in the horizontal direction is located at most approximately 50 mm, preferably approximately 25 mm to approximately 45 mm, from the inside flank or lateral surface of the rail. In the vertical direction, the distance from the front tip of the rail head-side end portion of the outlet to the top surface of the rail head between the second position and the first position can remain unchanged and can measure, for example, up to approximately 20 mm. Alternatively, in the first position, the distance from the front tip of the end portion on the rail head side to the top surface of the rail head in the vertical direction can measure more than approximately 40 mm, preferably more than approximately 55 mm, and in the second position, it can measure a maximum of approximately 20 mm, preferably a maximum of approximately 15 mm.

In the second, activated position, the lubricant in concentrated form is applied directly to the rail head, preferably to the top surface of the rail head. Thus, the lubricant very specifically reaches the point targeted for lubrication and/or wetting. In addition, because of reduced leakage of the lubricant into the railbed, damage to the environment is reduced since the lubricant is not distributed by means of a nozzle and compressed air over a wide area but, because of the close proximity of the outlet to the point to be lubricated and/or wetted, is instead applied only to a very small circumscribed area. In addition, the consumption of lubricant is reduced since the direct application to the rail head requires smaller quantities of lubricant.

Due to the movability of the rail head-side end portion of the outlet between the first and the second position, the solution disclosed by the present invention ensures that in the intervals in which no wetting and/or lubricating agent is applied to the rail head, the outlet of the device is disposed at a safe distance from the rail and/or the rail head so that the movement of a rail-bound vehicle passing on the tracks is not affected.

To avoid that rail-bound vehicles are impaired in this manner by devices disposed on the rail, railway operators frequently specify a so-called clearance, which is an area in which rigid and immovable components are not allowed and which, for example, in a direction at right angles to the rail, measures approximately 135 mm, and in a direction perpendicular to the top surface of the rail head, i.e., in the vertical direction, measures approximately 55 mm. The first position of the device according to the present invention is selected in such a manner that the outlet is disposed outside the clearance, while in the second position, the rail head-side end portion of the outlet is disposed inside the clearance.

In a preferred practical example of the invention, the rail head-side end portion of the outlet has the shape of a tube. This makes it possible to produce the outlet at low cost.

It is recommended that the rail head-side end portion of the outlet be flexible, for example, elastically bendable and/or compressible. This design ensures that in cases in which there is a malfunction of the feed drive causing part of the rail head-side end portion to remain inside the clearance, in spite of the fact that it should be in the rest position outside the clearance, the risk of an accident involving a rail-bound vehicle traveling on the track is minimized.

For the same reason, it is recommended that the rail head-side end portion of the outlet be made of a material that is inexpensive and can be easily produced. Preferably, the rail head-side end portion of the outlet comprises a plastic material, preferably polyamide (PA), or is completely made of this material. In addition, the rail head-side end portion can comprise carbon, for example, it is possible to use carbon fibers. The use of carbon has the advantage that this material imparts an increased stiffness to the tube.

For the same reason, it is recommended that the rail head-side end portion of the outlet be replaceable.

In another embodiment of the present invention, the rail head-side end portion of the outlet is held in a bearing block or can be moved jointly with a bearing block. In both cases, the bearing block is disposed in a manner to ensure that it cannot travel into the clearance. Holding the rail head-side end portion of the outlet inside a bearing block or moving it jointly with the bearing block has the effect that the feed and withdrawal movements are more readily controllable and thus become more reliable.

To allow the rail head-side end portion of the outlet to move, this end portion is connected to a drive unit which moves the rail head-side end portion of the outlet between the first position that is disposed at a remote distance from the rail head and the second position that is disposed in closer proximity to the rail head. To this end, the drive unit preferably comprises a plunger, with the movement of this plunger being transmitted to the rail head-side end portion of the at least one outlet and with the plunger being able to travel back and forth inside a cylinder so as to move the rail head-side end portion of the at least one outlet. Thus, the drive for moving the outlet can be easily implemented and easily controlled. The plunger/cylinder drive is at the same time able to transport the lubricant and/or wetting agent. This allows the device to be implemented at lower cost and with comparably smaller outside dimensions.

Alternatively, the drive unit comprises an electric or hydraulic drive that is decoupled from the pump for the lubrication system.

In the above-described practical example with a plunger and cylinder drive, the cylinder comprises a chamber on the rail head side and a chamber that faces away from the rail head, with the chamber on the rail head side being connectable to the lubricant reservoir via a relief line and with the chamber facing away from the rail head being connectable to the lubricant reservoir via a pump.

In addition, it is useful for a section of the lubricating line that follows the rail head-side end portion of the outlet in the direction of the pump to be movable and/or flexible, e.g., elastically bendable and/or compressible. This section of the lubricating line follows the movement of rail head-side end portion between the first and the second position while the remaining components of the device, at least with respect to the system (e.g., railbed or rail-bound vehicle) holding the device, are stationary.

A device as disclosed by the present invention that has a plurality of outlets, for example, 4 or 8 outlets, and offers advantages with respect to the distribution of the lubricant can be implemented in that each outlet is connected to one respective output of a progressive distributor. An alternative is a single-line distributor or a decentralized distribution system for the lubricant.

Another practical example of the device according to the present invention provides for a monitoring unit that monitors the position of the outlet and/or the position of the bearing block. The objective of the monitoring system is to check whether the feed movement to the second position and/or the withdrawal movement back to the first position of rail head-side end portion of the outlet or of the bearing block has taken place, and if so, in which position the rail head-side end portion of each outlet is currently located. In this manner, it can be determined whether or not part of the outlet is still within the clearance. In addition, maintenance personnel can be tasked to visually inspect the functional status of the rail head-side end portion of the outlet.

The device according to the present invention can be disposed next to a rail that comprises the rail head, i.e., it can be stationarily mounted, or it can be disposed in a (moving) rail-bound vehicle.

Advanced embodiments, advantages and possible applications of the invention follow from the subsequent description of practical examples of the present invention and from the figures. All features described and/or graphically represented, separately or in any combination with one another, are within the scope of the invention, regardless of their combination in the claims and regardless of how any one claim may refer back to any other claim.

BRIEF DESCRIPTION OF DRAWINGS

As can be seen.

DETAILED DESCRIPTION

Figure 1:
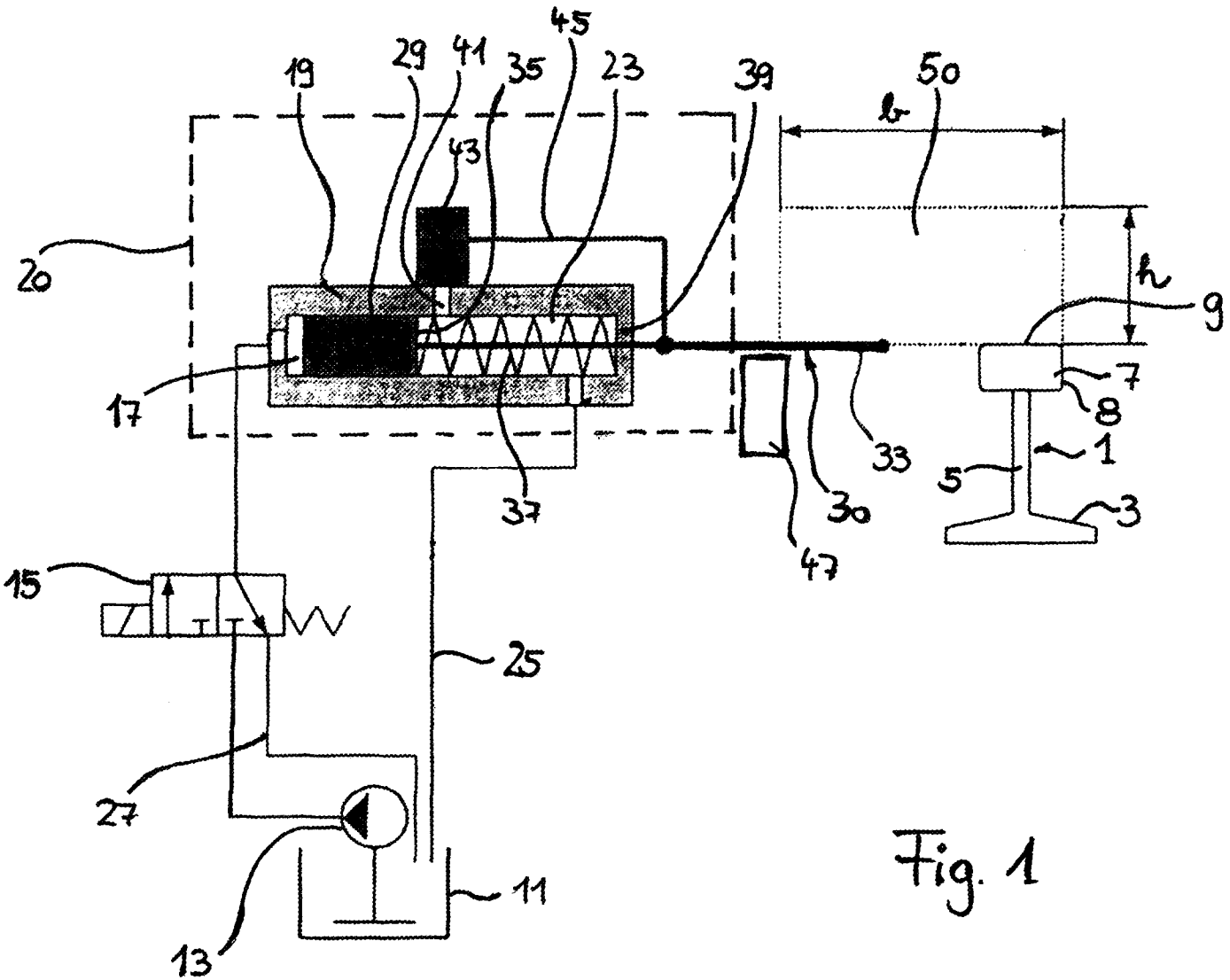
FIGS. 1 and 2 show a first practical example of the device according to the present invention in the form of a schematic sketch.

FIG. 1 shows a cross section of a rail 1, comprising a flange-like foot 3, a web 5 which, from the foot, extends in the upward direction, and a rail head 7. The rail head 7 is disposed on top of the web 5. The rail head 7 has a top surface 9 onto which the wetting and/or lubricating agent is to be applied by means of the device according to the present invention.

The device for wetting and/or lubricating the rail head 7 is disposed on the side of the rail 1, in particular outside the space in which a rail-bound vehicle traveling on the rail 1 moves, and, for example, in a curve section. Hereinafter, the device according to the present invention will, in short, be referred to as lubrication device.

In a first practical example of the present invention, the lubrication device according to the present invention can comprise, for example, eight outlets 30 as shown in FIG. 1. However, the device may also have fewer or more outlets 30. In cases in which a plurality of outlets 30 are present, each outlet is disposed along the rail 1 at a specific predetermined distance from the next outlet, for example, a distance between approximately 80 mm and approximately 170 mm, preferably between approximately 100 mm and approximately 150 mm.

The lubrication device comprises a lubricant reservoir 11 from which a lubricant and/or wetting agent (hereinafter referred to, in short, as lubricant) is transported by a lubricating pump 13 via a 3/2 way valve 15 into a chamber 17 of a cylinder 19 disposed in a drive unit 20, which chamber faces away from the rail head 7. A rail head-side chamber 23 of the cylinder 19 is connected to the lubricant reservoir 11 via a relief line 25. In addition, the input (and output), on the side of the lubricant reservoir, of the chamber 17 of the cylinder 19 facing away from the rail head, is connected by way of the 3/2 way valve 15 to the lubricant reservoir 11 via a return line 27 that is not operated by the pump 13.

A movable plunger 29 disposed in the cylinder 19 is mechanically connected to the outlet 30 of the lubrication device in such a manner that the rail head-side end portion 33 of the outlet follows the movement of the plunger 29. In addition, the rail head-side end face 35 of the plunger 29 is connected via return spring 37 to the oppositely lying end face 39 of the rail head-side chamber 23 of the cylinder 19. A third output 41 of the cylinder 19 is connected to the outlet 30 via a distributor 43 and a lubricating line 45 so as to transport fluid.

In an embodiment comprising a plurality of outlets, for example, four outlets 30 can be connected to a distributor 43 which is preferably a progressive distributor or a single-line distributor. In addition, as a rule, the drive unit 20 activates all outlets 30 of a lubrication device. As an alternative, a separate drive unit 20 can be provided for activating groups of outlets 30, in the practical example currently discussed, groups with eight outlets 30, e.g., for four outlets 30 each.

Figure 2:
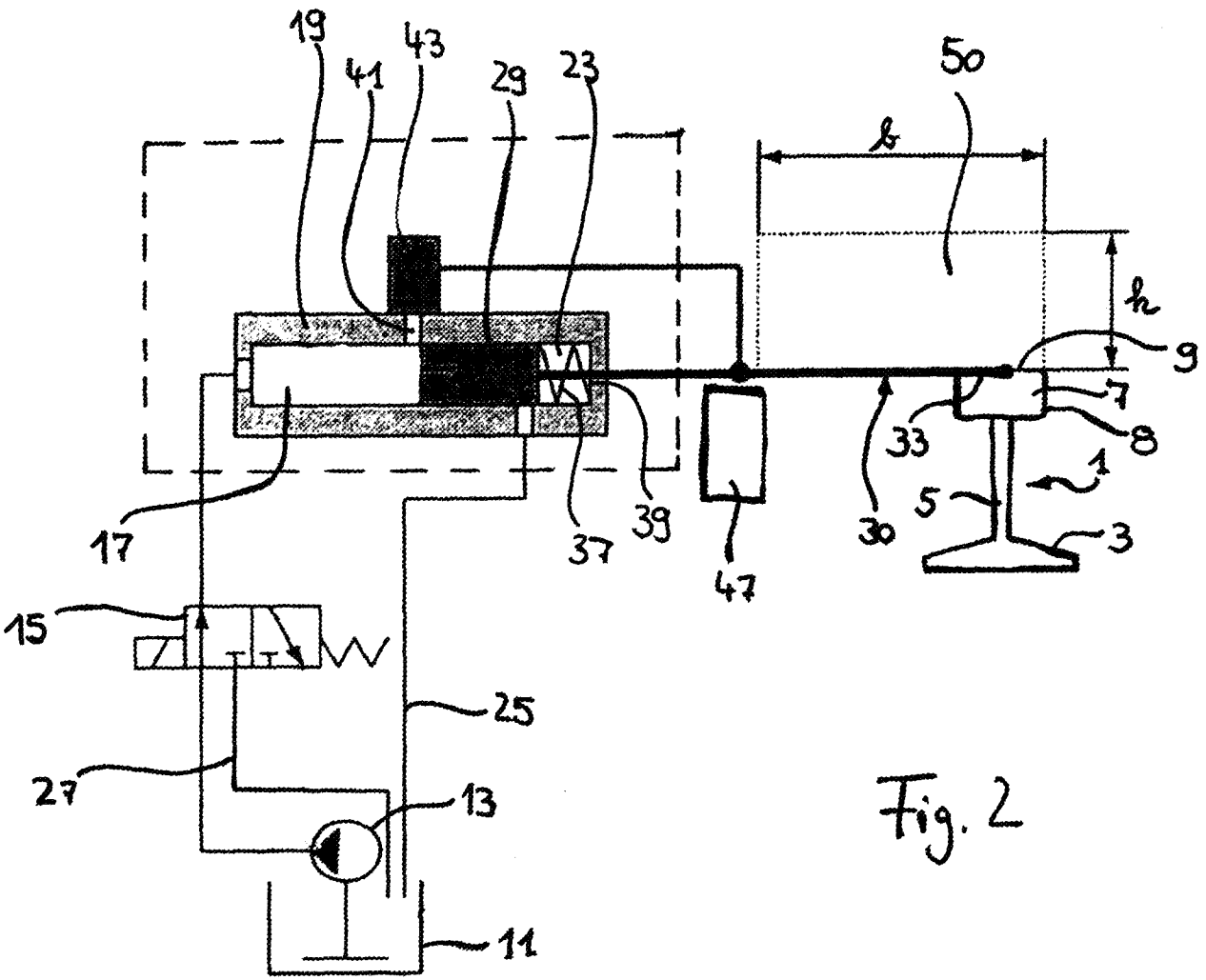
Figure 3:
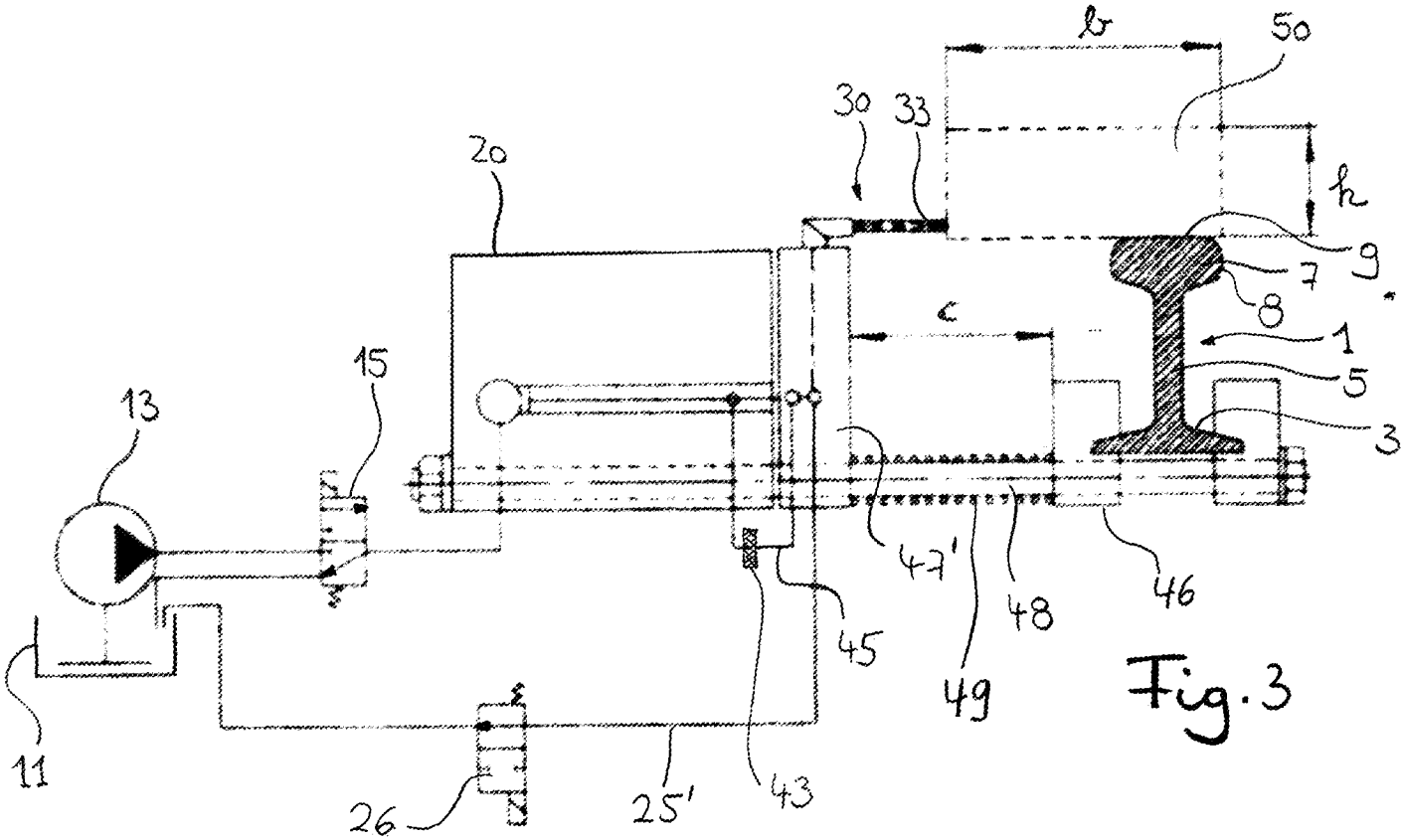
FIGS. 3 and 4 show a second practical example of the device according to the present invention, again in the form of a schematic sketch.
Figure 4:
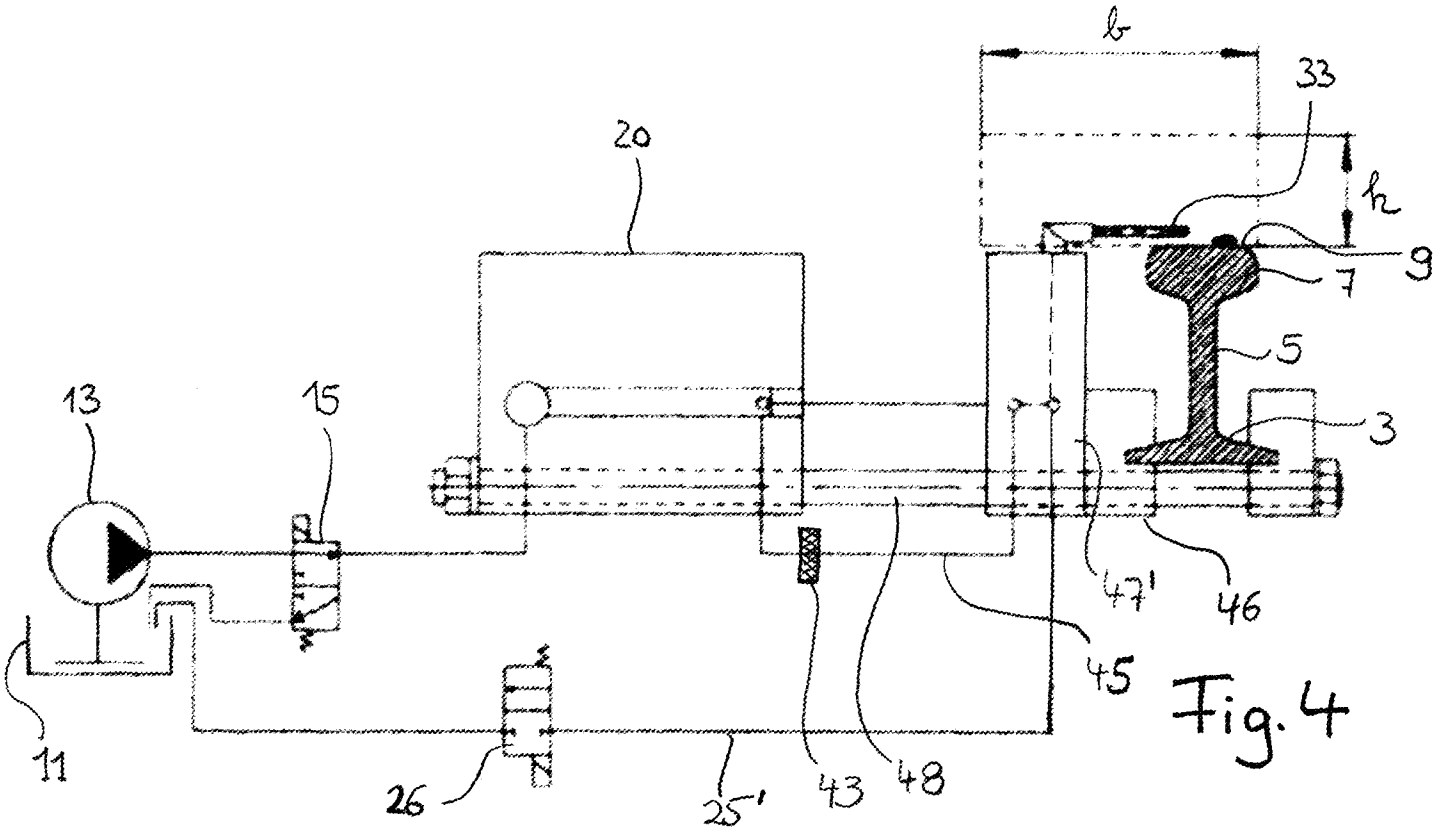

The rail head-side end portion 33 of the outlet 30 for the lubricant is a flexible tube and is made, for example, of a plastic, such as polyamide (PA). The rail head-side end portion 33 is held in a bearing block 47 which is disposed outside a clearance 50. In FIGS. 1 and 2, the clearance 50 is surrounded by dotted lines, and the clearance 50 in FIGS. 3 and 4 is defined by a dashed line.

The clearance 50 is a three-dimensional space which extends along the rail 1 directly above the top surface 9 of the rail head 7 and which has a predetermined height h (i.e., in the vertical direction) measuring, for example, approximately 55 mm. The clearance 50 has a predetermined width b measuring, for example, approximately 135 mm and extending from the inside flank 8 of the rail head 7 in the outward direction.

FIG. 1 shows the position of the lubrication device in which the rail head-side end portion 33 of the outlet 30 is in a position at a remote distance from the rail head, i.e., in the rest position or outside or on the edge of the clearance 50.

In contrast, FIG. 2 shows the position of the device according to the present invention at a point in time at which the rail head-side end portion 33 of the outlet 30 is disposed in a second position, i.e., while lubrication or wetting takes place and lubricant is applied to the top surface 9 of the rail head 7. To this end, the drive unit 20 moves the rail head-side end portion 33 into a position in which the front tip of the end portion is disposed above the top surface 9 of the rail head 7. In other words, in the second, i.e., activated, position, the rail head-side end portion 33 of the outlet 30 enters the clearance 50.

The movement of the end portion 33 on the rail head side between the first position shown in FIG. 1 and the second position shown in FIG. 2, as well as the method by which lubricant is dispensed, will be described below.

When a lubricating and/or wetting agent is to be applied to the rail head 7, the 3/2 way valve 15 is switched from the initial position of the device according to the invention shown in FIG. 1, and the pump 13 is connected to the chamber 17 facing away from the rail head 7. As a result, lubricant is pumped by means of the pressure generated in the pump 13 into the chamber 17 of the cylinder 19 facing away from the rail head 7. In addition, the pressure of the pump causes the plunger 29 to move toward the rail head 7 in opposition to the force exerted by the return spring 37. The output 41 of the cylinder 19 is initially connected to the rail head-side chamber 23 of the cylinder 19 and is subsequently closed by the plunger 29.

The movement of the plunger 29 toward the rail head 7, guided by the bearing block 47, causes the rail head-side end portion 33 to travel (move) toward the rail head 7 so that this end portion enters the clearance 50 and its front tip is eventually disposed above the rail head 7 (as shown in FIG. 2).

When the plunger 29 has been moved into a position in which it is very close to the rail head 7, the output 41 of the cylinder 19 is opened and connected to the chamber 17 of the cylinder 19 facing away from the rail head 7. Thus, it is possible for lubricant to be transported by means of pump 13 via the distributor 43 and the lubricating line 45 into the rail head-side end portion 33 of the outlet 30 precisely at the time at which the outlet 30 is located in the second, i.e., activated, position. Since the outlet 30 is movable, the lubricating line 45 is also movable and flexible, and it is sufficiently long that it can follow the movement of the outlet 30.

After conclusion of the lubricating procedure, the 3/2 way valve 15 switches over. As a result, the pump 13 is no longer connected to the chamber 17 of the cylinder 19. Since pump pressure is absent, the force of the return spring 37 moves the plunger 29 back into the initial position shown in FIG. 1. Excess lubricant present in the chamber 17 facing away from the rail head 7 is returned into the lubricant reservoir 11 via the 3/2 way valve 15 and the return line 27.

The second practical example shown in FIGS. 3 and 4 essentially has a design that is comparable to the one in the first practical example that is shown in FIGS. 1 and 2. Components of the device or the rail having identical functions are identified by identical reference symbols.

However, in the second practical example shown in FIG. 3 (rest position, not activated) and in FIG. 4 (in activated position), the rail head-side end portion 33 of the outlet 30, jointly with the bearing block 47', is moved between the first and the second position along a feed path c. To this end, the bearing block 47' moves, for example, on a guide 48, which can have the form of a guide rail, along the feed path c between the drive unit 20 and a stop block 46 outside the clearance 50. Toward the rail head 7, a return spring 49, which is disposed between the bearing block 47' and the stop block 46, can act in opposition to the movement of the bearing block 47'.

The 2/2 way valve 26 disposed in the relieve line 25' as shown in FIGS. 3 and 4, in combination with the distribution of the lubricant by means of the progressive distributor, serves to reduce the residual pressure upstream of the progressive distributor as quickly as possible so as to prevent a continued operation of the progressive distributor and to avoid that lubricant is dispensed in the rest position. The 2/2 way valve 26 can similarly also be incorporated in the first practical example, especially if the device in this example comprises a progressive distributor. If the device according to the present invention does not comprise a progressive distributor, this valve can be omitted.

Another practical example (not shown in FIGS. 1-4) comprises a monitoring unit which monitors the position of the rail head-side end portion 33, for example, its front tip (in the first practical example according to FIGS. 1 and 2) or the bearing block 47' (in the second practical example according to FIGS. 3 and 4). To this end, for example, an optical position recognition device can be used. Especially with reference to the second practical example, an electric/electronic position recognition device, which is disposed, for example, in the guide 48, can be used.

LIST OF REFERENCE SYMBOLS

1 Rail
3 Foot of the rail 1
5 Web of the rail 1
7 Rail head
8 Inside flank/inside lateral surface of the rail head 7
9 Top surface of the rail head 7
11 Lubricant reservoir
13 Pump
15 3/2 way valve
17 Chamber of the cylinder 19 facing away from the rail head 7
19 Cylinder
20 Drive unit
23 Rail head-side chamber of the cylinder 19
25, 25' Relief line
26 2/2 way valve
27 Return line
29 Plunger
30 Outlet
33 Rail head-side end portion of the outlet 30
35 End face of the plunger 29
37 Return spring (compression spring)
39 Rail head-side end face
41 Output of the cylinder 19
43 Distributor
45 Lubricating line
47, 47' Bearing block
48 Guide
49 Return spring (compression spring)
50 Clearance
b Width of the clearance 50
h Height of the clearance 50
c Feed path

The invention claimed is:

1. A device for wetting or lubricating a rail head, said device comprising at least one outlet for a wetting and/or lubricating agent, characterized in that:

a rail head-side end portion of the at least one outlet is movably mounted between a position at a remote distance from the rail head and a position in closer proximity to the rail head;

the outlet is connected to a drive unit that moves the rail head-side end portion of the outlet between the position at a remote distance from the rail head and the position in closer proximity to the rail head;

the drive unit comprises a cylinder and a plunger that is movable in the cylinder and connected to the rail head-side end portion of the at least one outlet, with the plunger being able to travel back and forth inside the cylinder so as to move the rail head-side end portion of the at least one outlet; and the cylinder comprises a first chamber on the rail head side and a second chamber facing away from the rail head, with the first chamber being connectable to a lubricant reservoir via a pump and with the second chamber being connectable to the lubricant reservoir via a relief line.

2. The device as in claim 1, characterized in that the rail head-side end portion of the outlet has the shape of a tube.

3. The device as in claim 1, characterized in that the rail head-side end portion of the outlet is flexible and comprises a plastic material.

4. The device as in claim 1, characterized in that the rail head-side end portion of the outlet is replaceable.

5. The device as in claim 1, characterized in that the rail head-side end portion of the outlet is held in a bearing block or can be moved jointly with the bearing block.

6. The device as in claim 1, characterized in that a lubricating line section that follows the rail head-side end portion of the outlet is movable and/or flexible.

7. The device as in claim 1, characterized in that the outlet is connected to the output of a progressive distributor or a single-line distributor.

8. The device as in claim 1, characterized in that a monitoring unit monitors the position of the outlet and/or the position of the bearing block.

9. The device as in claim 1, characterized in that the device is stationarily disposed next to a rail that comprises the rail head or is disposed in a rail-bound vehicle.

* * * * *